US008777026B2

(12) United States Patent
Han et al.

(10) Patent No.: US 8,777,026 B2
(45) Date of Patent: Jul. 15, 2014

(54) CRANE JIB TRANSITION STRUCTURE

(75) Inventors: Fenglin Han, Shanghai (CN); Mingqi Li, Shanghai (CN)

(73) Assignees: Hunan Sany Intelligent Control Equipment Co., Ltd., Changsha (CN); Kushan Sany Mechanical Co., Ltd., Jiangsu (CN)

( * ) Notice: Subject to any disclaimer, the term of this patent is extended or adjusted under 35 U.S.C. 154(b) by 162 days.

(21) Appl. No.: 13/318,281

(22) PCT Filed: Jun. 27, 2011

(86) PCT No.: PCT/CN2011/001056

§ 371 (c)(1),
(2), (4) Date: Apr. 26, 2012

(87) PCT Pub. No.: WO2012/009950

PCT Pub. Date: Jan. 26, 2012

(65) Prior Publication Data

US 2012/0205336 A1 Aug. 16, 2012

(30) Foreign Application Priority Data

Jul. 21, 2010 (CN) ..... 2010 1 0232241

(51) Int. Cl.
*B66C 23/70* (2006.01)

(52) U.S. Cl.
CPC ..... *B66C 23/70* (2013.01)
USPC ..... 212/177; 212/299

(58) Field of Classification Search
USPC ..... 212/177, 299, 300, 306, 258
See application file for complete search history.

(56) References Cited

U.S. PATENT DOCUMENTS

| | | | | | |
|---|---|---|---|---|---|
| 1,481,351 | A | | 1/1924 | Cochran | |
| 2,905,280 | A | | 9/1959 | Weaver | |
| 3,366,250 | A | * | 1/1968 | Grove | 212/300 |
| 3,842,983 | A | * | 10/1974 | Dolza | 212/236 |
| 3,939,988 | A | * | 2/1976 | Wellman | 212/297 |
| 4,337,601 | A | * | 7/1982 | Vaerk et al. | 52/118 |
| 4,383,616 | A | * | 5/1983 | Sterner et al. | 212/299 |

(Continued)

FOREIGN PATENT DOCUMENTS

| | | | |
|---|---|---|---|
| CN | 101880012 | A | 11/2010 |
| GB | 2 136 391 | A | 9/1984 |
| JP | A-2004-035116 | | 2/2004 |

OTHER PUBLICATIONS

International Search Report issued in International Application No. PCT/CN2011/001056 dated Aug. 25, 2011 (with translation).

*Primary Examiner* — Emmanuel M Marcelo
(74) *Attorney, Agent, or Firm* — Robert M. Downey. P.A.

(57) ABSTRACT

Provided is a crane jib transition structure, including a jib section, a transition section and a supporting structure. The jib section matches with the transition section, and they fixedly connect to each other. The upper end of the supporting structure fixedly connects to the upper end of the side of the jib section. The bottom end of the supporting structure fixedly connects to the bottom end of the corresponding side of the transition section. The middle part of the supporting structure fixedly connects to the connection point between the side of jib section and the corresponding side of transition section. Therefore, the crane jib transition structure can not only achieve the strength of a crane jib transition structure, but also achieve the strength and the overall stability of a crane jib, by using the supporting structure connecting to between the crane jib section and transition section.

8 Claims, 5 Drawing Sheets

(56) References Cited

U.S. PATENT DOCUMENTS

| | | | | |
|---|---|---|---|---|
| 6,036,035 | A * | 3/2000 | Asano et al. | 212/300 |
| 6,422,408 | B1 * | 7/2002 | Lissandre et al. | 212/270 |
| 6,679,394 | B2 * | 1/2004 | Schuffert et al. | 212/299 |
| 7,093,730 | B2 * | 8/2006 | Saint-Gerand | 212/295 |
| 7,156,245 | B2 * | 1/2007 | Lissandre | 212/177 |
| 2001/0045405 | A1 | 11/2001 | Higgins | |
| 2007/0056922 | A1 * | 3/2007 | Ciaburro | 212/175 |
| 2009/0107945 | A1 * | 4/2009 | Ehrenleitner | 212/176 |

* cited by examiner

CRANE JIB TRANSITION STRUCTURE

FIELD OF INVENTION

The present invention relates to a crane jib, and in particular, relates to a crane jib transition structure.

BACKGROUND OF INVENTION

Nowadays, the truss jib of a crane is made up of many jib sections. In general the cross-section of the jib section is a rectangle or other polygons. According to the different design requirements for a crane, the cross-section of the jib section is usually different. In order to use the jib sections having different dimensions of the cross-section on the same jib, usually two jib sections having different dimensions of the cross-section are connected each other by using transition section, as shown in FIG. 1 and FIG. 2. However, the above mentioned structure leads to the change of dimensions of the cross-section of the jib, thus it will affect the strength and the overall stability of a crane jib structure, and it will make some security problems of operation of the crane.

SUMMARY OF THE INVENTION

The purpose of the present invention is to provide a crane jib transition structure, which can achieve direct and stable connection between a crane jib section and a transition section, thereby it can increase the strength and the overall stability of a crane jib structure.

In order to achieve the above purpose, the crane jib transition structure of the present invention, mainly including a jib section, a transition section and a supporting structure, wherein, said jib section matches with said transition section, and they fixedly connect to each other, the upper end of said supporting structure fixedly connects to the upper end of the side of said jib section, the bottom end of said supporting structure fixedly connects to the bottom end of the corresponding side of the transition section, the middle part of said supporting structure fixedly connects to the connection point between the side of jib section and the corresponding side of transition section.

The above mentioned crane jib transition structure, wherein, said supporting structure is a box beam, and one box beam is positioned on each side of the corresponding jib section.

The above-mentioned crane jib transition structure, wherein, said supporting structure is a truss jib, and one truss jib is positioned on each side surface of the corresponding jib section, wherein said side surface is an outer side surface of jib section, including two adjacent sides.

The above mentioned crane jib transition structure, wherein, said truss jib is a trapezoid structure.

The above mentioned crane jib transition structure, wherein, said supporting structure is connected to said jib section by bearing pins or high-strength bolts.

The above mentioned crane jib transition structure, wherein, said supporting structure is connected to the said transition section by bearing pins or high-strength bolts.

The above mentioned crane jib transition structure, wherein, said supporting structure is made up of steel pipe.

The above mentioned crane jib transition structure, wherein, said steel pipe is a seamless steel pipe.

Therefore, the crane jib transition structure of the present invention can not only achieve the strength of a crane jib transition structure, but also achieve the strength and the overall stability of a crane jib, by using a supporting structure connecting to between the crane jib section and transition section, which have simpler structure, easier installation, lower production cost and can be widely used in various types of cranes.

DETAILED DESCRIPTION OF THE PREFERRED EMBODIMENT

The illustration of the present invention should be made to the following detailed description taken in conjunction with the accompanying drawings:

In general, a crane jib structure is made up of many jib sections. When the jib structures have different dimension need to be connected to each other, a transition section will be used as a connection means between two jib sections. The crane jib transition structure of the present invention can achieve stable connection between a jib section and a transition section, thus it will make the overall jib be operated stability. Wherein, the jib transition structure includes a jib section, a transition section and a supporting structure. Wherein, the jib matches with the transition section, and the end-face of the transition section has the same size with the end-face of the jib section, and they can connect each other. However, the upper end of the supporting structure fixedly connects to the upper end of the side of the jib section, the bottom end of the supporting structure fixedly connects to the bottom end of the corresponding side of the transition section, the middle part of the supporting structure fixedly connects to the connection point between the side of jib section and the corresponding side of transition section. The supporting structure is made up of steel pipe, in particular, seamless steel pipe. In addition, the supporting structure fixedly is connected to the jib section and the transition section by bearing pins or high-strength bolts. The above mentioned structure ensures the stability of the crane jib transition structure and the strength of the overall jib.

Figure 1:
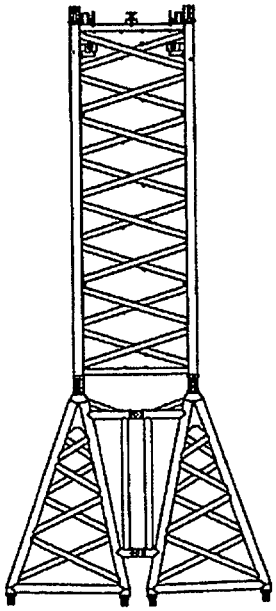
FIG 1 PRIOR ART
FIG. 1 shows a crane jib transition structure of existing technology.
Figure 2:
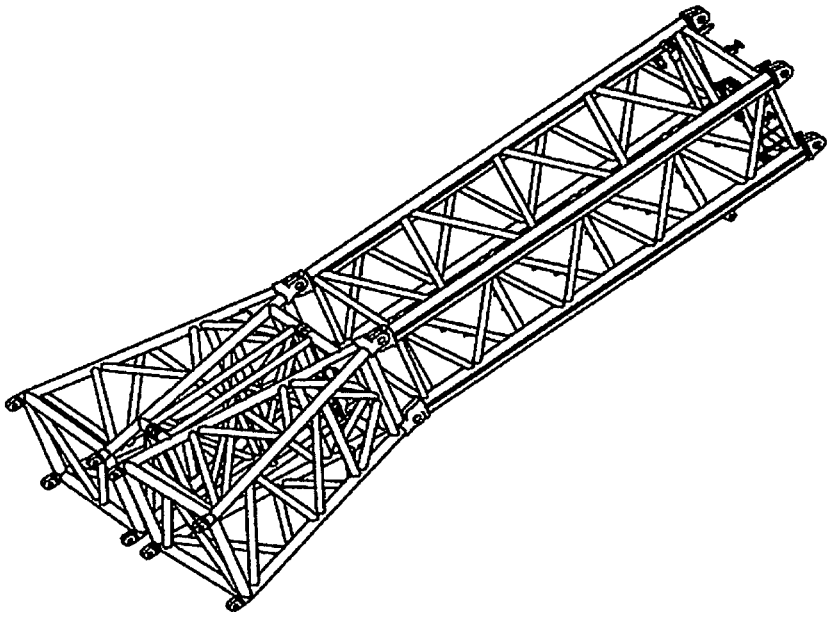
FIG 2 PRIOR ART
FIG. 2 shows three-dimensional structure of FIG. 1.
Figure 3:
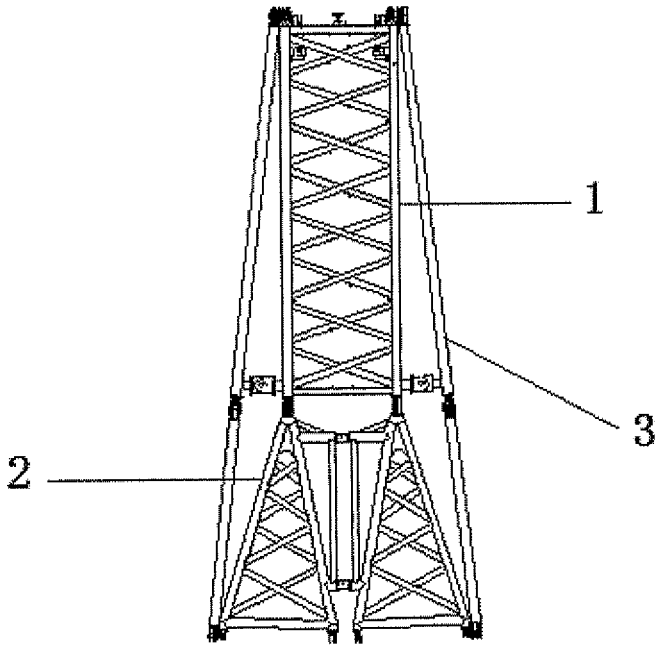
FIG. 3 shows the first preferred embodiment of the crane jib transition structure of the present invention.
Figure 4:
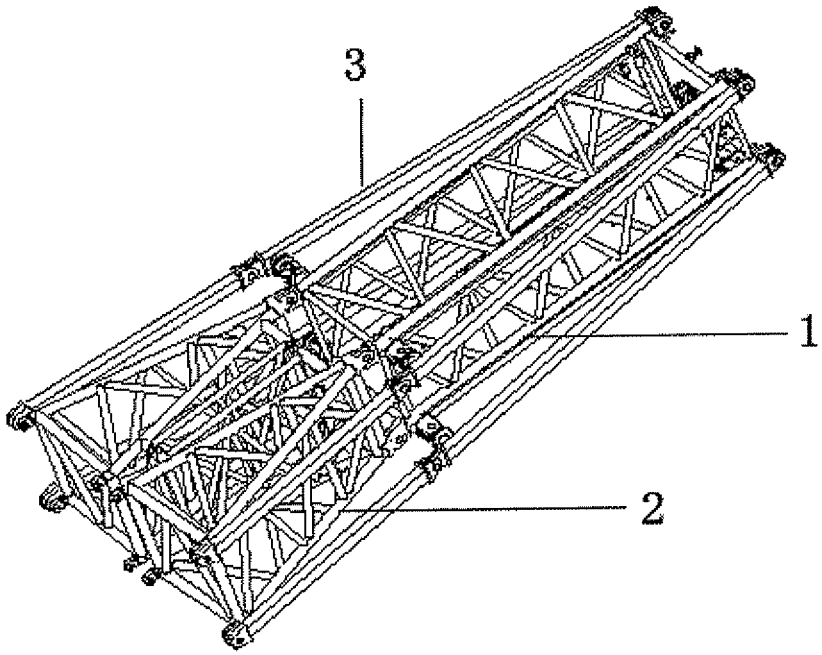
FIG. 4 shows three-dimensional structure of FIG. 3.
Figure 5:
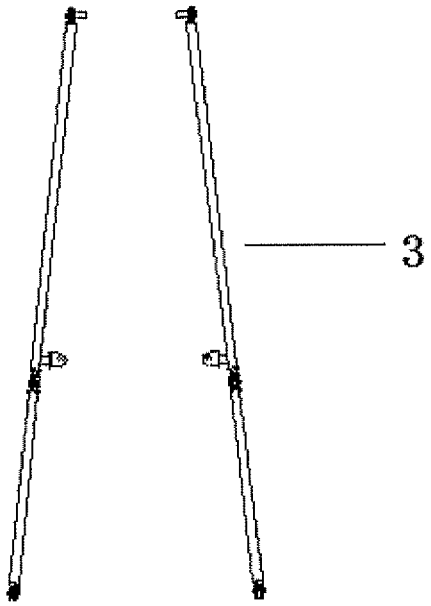
FIG. 5 shows the supporting structure of the first preferred embodiment of the crane jib transition structure of the present invention.
Figure 6:
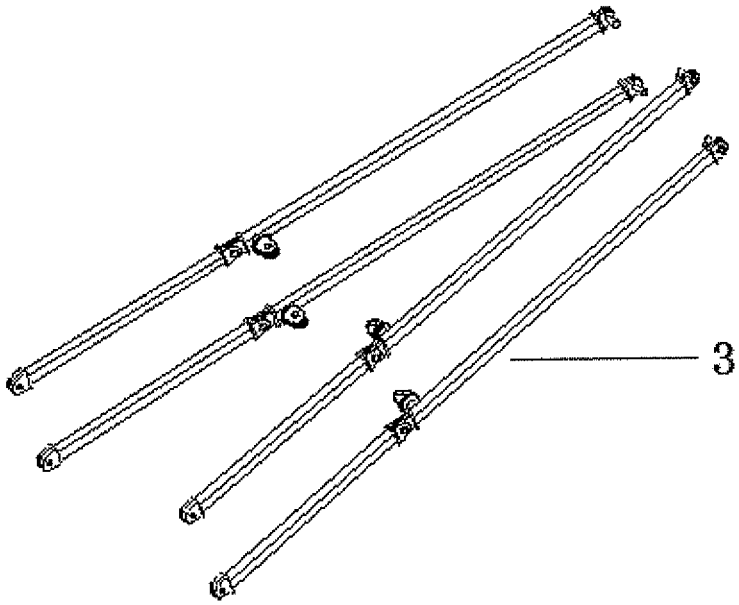
FIG. 6 shows three-dimensional structure of FIG. 5.

In the first preferred embodiment of the present invention, the supporting structure is a box beam. FIG. 3 and FIG. 4 shows the transition structure of the crane jib equipped with the box beam 3, the structure of the box beam 3 showed in FIG. 5 and FIG. 6. The figure shows the upper end of the box beam 3 fixedly connects to the upper end of the side of the jib section 1, the bottom end of the box beam 3 fixedly connects to the bottom end of the side of the transition section 2, the middle part of the box beam 3 fixedly connects to the connection point of the jib section 1 and the side of the transition section 2, which are in the corresponding side of the jib section 1 and transition section 2. Wherein the bearing pins used to connect can flexibly move on the box beam, thus which can connect to jib section 1 and transition section 2 at the right position, which can slow the change of the jib effectively, and ensure the stability and the strength of the overall jib.

Figure 7:
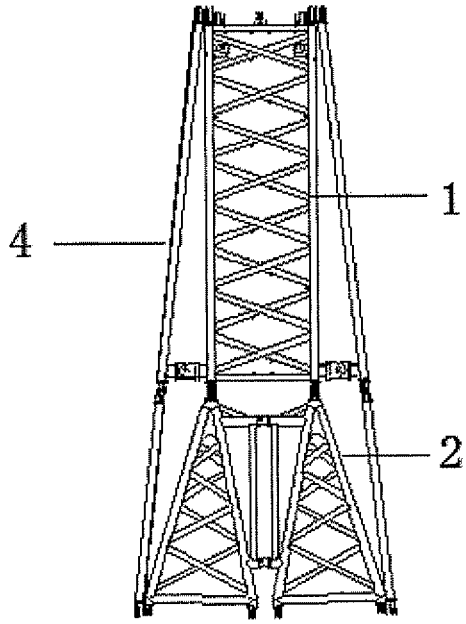
FIG. 7 the second preferred embodiment of the crane jib transition structure of the present invention.
Figure 8:
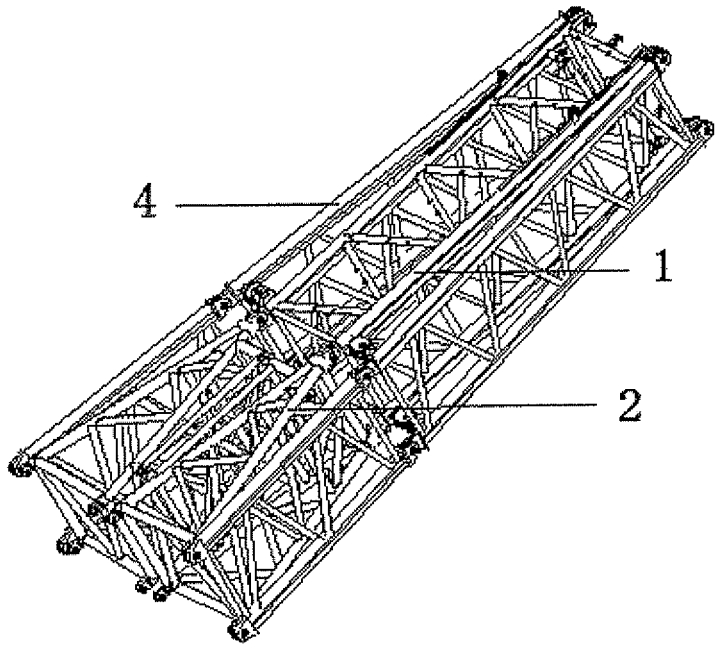
FIG. 8 shows three-dimensional structure of FIG. 7.
Figure 9:
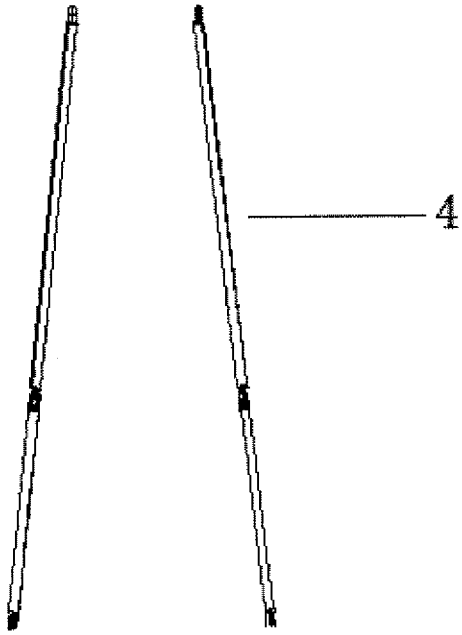
FIG. 9 shows the supporting structure of the second preferred embodiment of the crane jib transition structure of the present invention.
Figure 10:
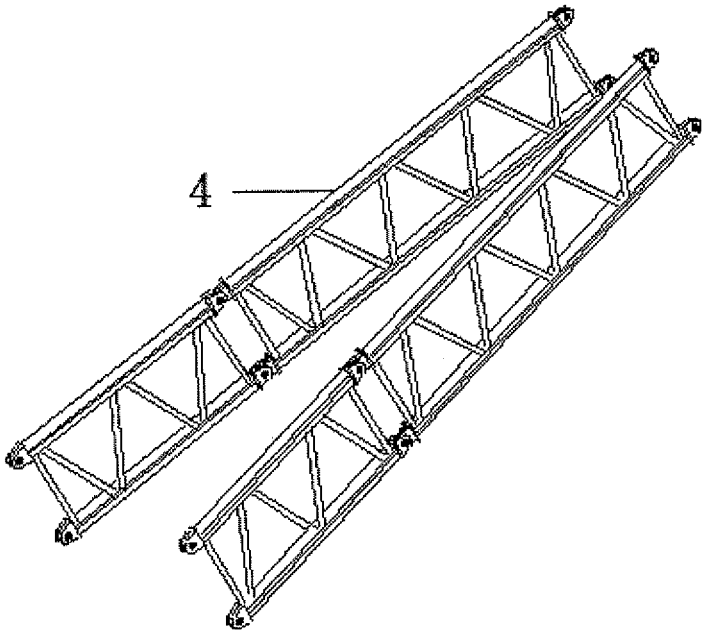
FIG. 10 shows three-dimensional structure of FIG. 9.

In the second preferred embodiment of the present invention, the supporting structure is a truss jib. FIG. 7 and FIG. 8 shows the transition structure of the crane jib equipped with the truss jib 4, the structure of the truss jib 4 is showed in FIG. 9 and FIG. 10. The figure shows the truss jib 4 is a trapezoid structure, which is equipped on the side surface of the jib section 1, the side surface is an outer side surface of jib section, including two adjacent sides. The upper end of the truss jib 4 connects to the upper end of the side surface, the bottom end of the truss jib 4 connects to the bottom end of the side surface of the transition section 2. The middle part of the truss jib 4 connects to the connection place of the side surface where the jib section 1 and the transition section 2 locates. Similarly, the bearing pins used to connect can flexibly move on the truss jib, thus which can connect to jib section and transition section at the right position. Using the above mentioned truss jib can slow the change of the crane jib effectively, and ensure the stability and the strength of the overall crane jib.

Therefore, the crane jib transition structure of the present invention can not only achieve the strength of the crane jib transition structure, but also achieve the strength and the overall stability of the crane jib, by using a supporting structure connecting to between the crane jib section and the transition section, which have simpler structure, easier installation, lower production cost and can be widely used in various types of cranes.

Although the above reference figures have been explained in accordance with the invention and the idea and embodiment of the purpose of the invention, the person of ordinary skill can recognize that, in the absence of claims from the premise of limited range of conditions, you can still make various improvements to the invention and transformation, which still belongs to the protection scope of the invention.

The invention claimed is:

1. A crane jib transition structure, including a jib section, a transition section and a supporting structure, said jib section having an upper end, a bottom end with an end face, and end two sides each extending between the upper and bottom ends of the jib section, said transition section having an upper end with an end face, a bottom end, and two sides each extending between the upper and bottom ends of the transition section, the end face of the transition section having the same size with the end face of the jib section, and the upper end of the transition section and the bottom end of the jib section fixedly connecting to each other at a part between a side of the jib section and a side of the transition section, the supporting structure having an upper end, a bottom end and a middle part, the upper end of said supporting structure fixedly connecting to a side of the upper end of said jib section, the bottom end of said supporting structure fixedly connecting to a side of the bottom end of the transition section, the middle part of said supporting structure fixedly connecting to the part between the side of the jib section and the side of the transition section, said supporting structure being a box beam structure or a truss jib structure.

2. The crane jib transition structure according to claim 1, wherein, said supporting structure is a box beam structure and one box beam is positioned on each side of the jib section.

3. The crane jib transition structure according to claim 1, wherein, said supporting structure is a truss jib structure, and one truss jib is positioned on each side surface of the jib section, wherein said side surface is an outer side surface of the jib section.

4. The crane jib transition structure according to claim 3, wherein, said truss jib is a trapezoid structure.

5. The crane jib transition structure according to claim 1, wherein, said supporting structure is connected to said jib section by bearing pins or high-strength bolts.

6. The crane jib transition structure according to claim 1, wherein, said supporting structure is connected to said transition section by bearing pins or high-strength bolts.

7. The crane jib transition structure according to claim 1, wherein, said supporting structure is made up of steel pipe.

8. The crane jib transition structure according to claim 7, wherein, said steel pipe is a seamless steel pipe.

* * * * *